US006155957A

United States Patent [19]

Worley et al.

[11] Patent Number: 6,155,957

[45] Date of Patent: Dec. 5, 2000

[54] ATHLETIC ABILITY MEASURING DEVICE

[76] Inventors: Michael L. Worley, 75 Big Oak Dr., Fletcher, N.C. 28732; Dexter E. Diepholz, 120 Maywood Dr., Hendersonville, N.C. 28792; Joseph A. Worley, 23 Briar La., Fletcher, N.C. 28732

[21] Appl. No.: 09/434,894

[22] Filed: Nov. 5, 1999

[51] Int. Cl.[7] ..... A63B 21/00

[52] U.S. Cl. ..... 482/8; 482/15; 482/909

[58] Field of Search ..... 482/1–9, 14, 15, 482/909; 473/447

[56] References Cited

U.S. PATENT DOCUMENTS

| | | | |
|---|---|---|---|
| 4,208,050 | 6/1980 | Perrine et al. . | |
| 4,323,234 | 4/1982 | Glaese . | |
| 4,556,214 | 12/1985 | Petrofsky et al. | 482/1 |
| 4,625,962 | 12/1986 | Street | 482/116 |
| 4,932,137 | 6/1990 | Haley et al. . | |
| 5,072,931 | 12/1991 | Carlson . | |
| 5,838,638 | 11/1998 | Tipton et al. . | |
| 5,897,457 | 4/1999 | Machovjak | 482/8 |

OTHER PUBLICATIONS

Physio–Tek Inc., CAD TEX, all pages, Nov. 1987.

*Primary Examiner*—Glenn E. Richman
*Attorney, Agent, or Firm*—Joseph T. Guy

[57] ABSTRACT

Disclosed as an apparatus for measuring at least one performance metric of an athlete. The apparatus comprises an elongated tether with a first end and a second end. An attachment means is attached to the first end of the elongated tether wherein the attachment means can be attached to the athlete. A vertical jump by the athlete causes a displacement of the elongated tether proportional to a distance, or height, of the vertical jump. A retractor is attached to the second end of the elongated tether to withdraw the elongated tether after a jump. An encoder determines a magnitude of the displacement of the elongated tether and generates a signal proportional to the magnitude. A conversion device receives the signal from the encoder and converts the signal to the performance metric. An output device reports the performance metric.

19 Claims, 9 Drawing Sheets

ATHLETIC ABILITY MEASURING DEVICE

BACKGROUND OF THE INVENTION

The present invention is related to a device for quantifying athletic ability. The present invention is more specifically related to a device for measuring vertical leap ability of an athlete and the power generated with the vertical leap.

Athletes, and their coaches, are constantly striving to improve performance in their particular event. A critical part of this constant improvement is the ability to accurately and repeatable quantify various aspects of an athletes abilities.

One particular measurement which translates to ability in various sporting events is the standing vertical jump test. This test measures an athletes ability to jump from a standing position to the highest achievable height and relates to the power output of the athlete making the jump. Many devices are available which measure either the height reached or the elapsed time from leaving the surface to returning to the surface.

Devices which measure the highest point reached are legion in number as represented by U.S. Pat. Nos. 5,072,931; 4,208,050; 4,323,234; and 4,932,137. Each of these devices provide the athlete, or coach, with a quantitative measurement of the maximum height obtained. The maximum height is recorded without regard for jumping technique, weight, or other parameters which are critical to the evaluation of the power output of an athlete. For example, one athlete may jump from an upright position which would be indicative of the height obtained from a responsive jump in basketball, for example. A second athlete may squat and jump which is more indicative of a planned jump as in volleyball, for example. In each case the ability of the athlete may be reported very differently and the actual power of the athlete is not retrievable with the measurement technique. The height obtained is also dependent on other parameters which do not measure actual power such as the ability to reach for an object at the zenith of the jump. An athlete using maximum arm mechanics to enhance the jump may be less able to insure that the touch board, or equivalent, is contacted at the maximum height of the jump. The devices which measure height are useful but still lacking in their ability to fully determine an athletes ability.

Devices which measure elapsed time between leaving the surface and returning to the surface are also legion in number with representative examples being described in U.S. Pat. Nos. 5,897,457 and 5,838,638. These devices rely on a mathematical equation relating height obtained to jump time which is:

$$h=g\,(I/2)^2/2$$

wherein h is height obtained in inches, g is the standard acceleration due to gravity (384 inches/sec.$^2$) and I is the time interval in seconds. This measurement is also dependent on technique since an athlete which lands in a crouched position may achieve a longer elapsed time than one which lands more upright even for the same height achieved if measured at the abdomen, for example. Therefore, the measurement does not necessarily evaluate actual height jumped, vertical displacement or power output.

SUMMARY OF THE INVENTION

It is an object of the present invention to provide a device for measuring the abilities of an athlete.

It is another object of the present invention to provide a device for measuring the total vertical displacement of an athlete as measured from the lowest level to the highest level.

It is yet another object of the present invention to provide a device for measuring both the height obtained and the elapsed time for a jump.

A particular feature of the present invention is the ability to determine the power of an athlete by measurement of the vertical displacement and other parameters.

These and other features as will become apparent are provided in an apparatus for measuring at least one performance metric of an athlete. The apparatus comprises an elongated tether with a first end and a second end. An attachment means is attached to the first end of the elongated tether wherein the attachment means can be attached to the athlete. A vertical jump by the athlete causes a displacement of the elongated tether proportional to a distance, or height, of the vertical jump. A retractor is attached to the second end of the elongated tether to withdraw the elongated tether after a jump. An encoder determines a magnitude of the displacement of the elongated tether and generates a signal proportional to the magnitude. A conversion device receives the signal from the encoder and converts the signal to the performance metric. An output device reports the performance metric.

A particularly preferred embodiment is provided in an apparatus for measuring a performance metric of an athlete. The apparatus comprises a base which comprises a slot. A tether traverses the slot. An attachment means is attached to the tether and is capable of being attached to the athlete such that when the athlete moves away from the base the tether is withdrawn from the base through the slot creating a displacement. Coupled with the tether is an encoder capable of measuring the displacement and generating a signal wherein the signal corresponds to a magnitude of displacement. A retractor is attached to the tether wherein the retractor biases the tether into the base. An output device receives the signal from the encoder and converts the signal to the performance metric.

Yet another embodiment is provided in an apparatus for measuring a power output comprising an elongated tether with a first end and a second end. An attachment means is attached to the first end of the tether and a retractor is attached to the second end of the tether wherein the retractor allows the tether to be withdrawn from the retractor while remaining taught between the first end and the second end. An encoder for determining a displacement of the tether is coupled to the tether and generates a signal proportional to the displacement. A timer is integrated with the encoder and capable of measuring an elapsed time for the displacement. An input device is provided for inputting a weight required to withdraw said tether and a conversion device receives the signal, the elapsed time and the weight and calculates the power output. A display device displays the power output.

DETAILED DESCRIPTION OF THE INVENTION

Throughout the following description similar elements are numbered accordingly.

Figure 1:
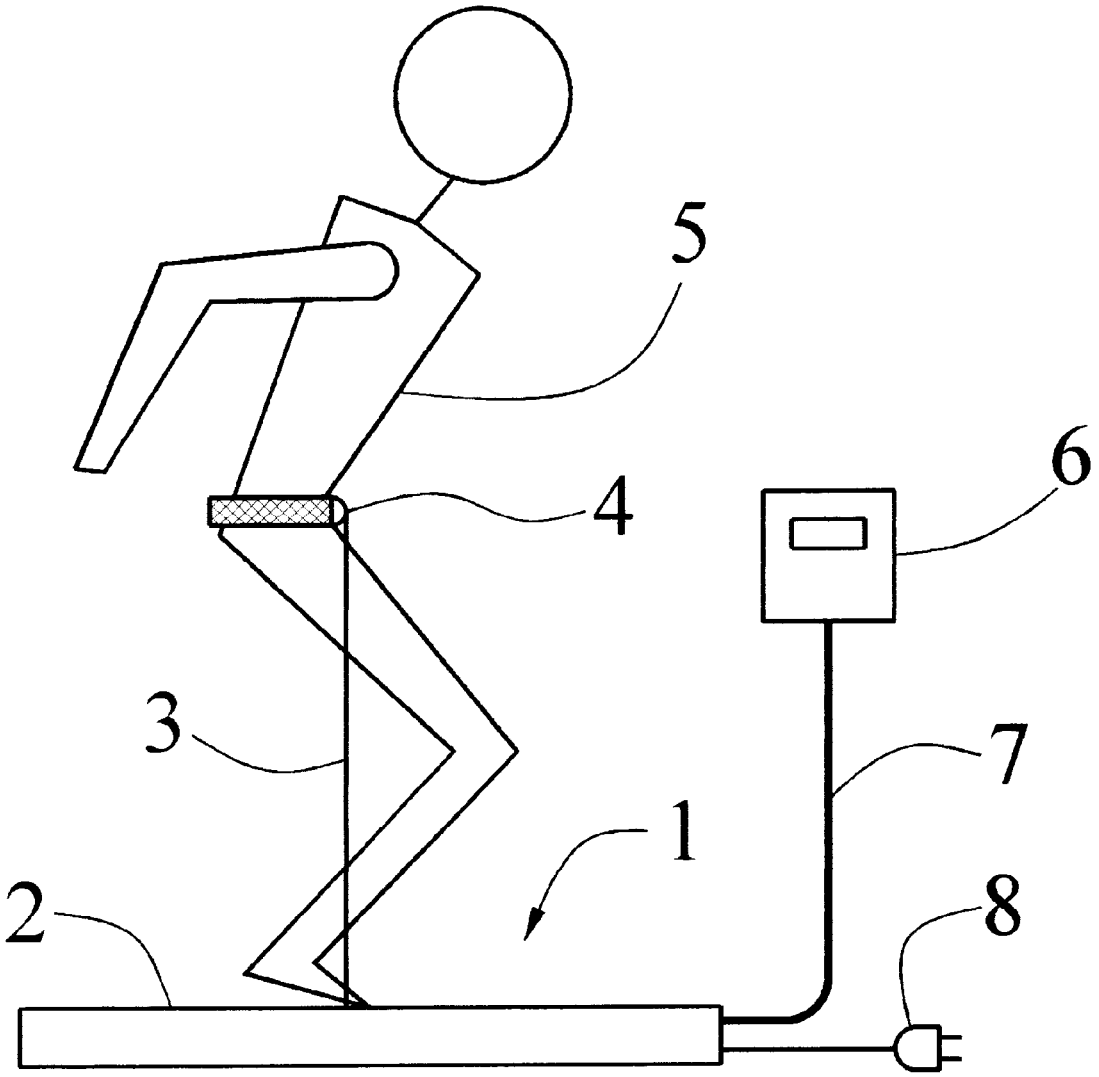
FIG. 1 is a side view of the inventive device with an athlete preparing to jump upward.

The general device and its operation are illustrated in FIG. 1. The performance measurement device, generally represented at 1, comprises a platform, 2, upon which the athlete, 5, jumps from and lands on during the test. The athlete is attached to a retractable tether, 3, by a tether attachment means, 4. As the athlete squats to jump the tether retracts into the platform by a mechanism described later. The tether then is withdrawn from the platform as the athlete jumps upward and the total displacement is the distance the tether is withdrawn from the platform. The distance the tether is withdrawn is measured by a displacement measuring device. The time interval of the total displacement is also determined as described later. The total displacement and time interval, or performance metrics determined from these measurements, are then reported by an input/output device, 6, which is attached by a signal transfer means, 7. The performance measurement device is powered by an appropriate power source, 8.

Figure 2:
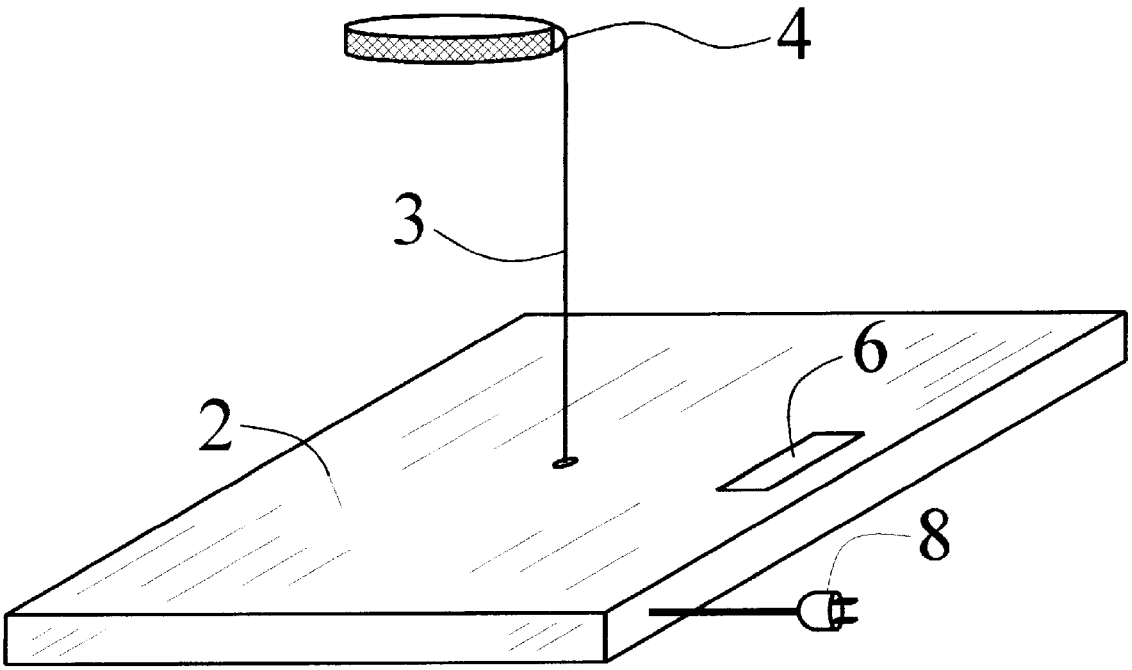
FIG. 2 is a top-side view of an embodiment wherein the display is incorporated into the platform.

FIG. 2 is a top side view of the inventive device similar to that described relative to FIG. 1. In FIG. 2 the input/output device, 6, is mounted in the platform.

Figure 3:
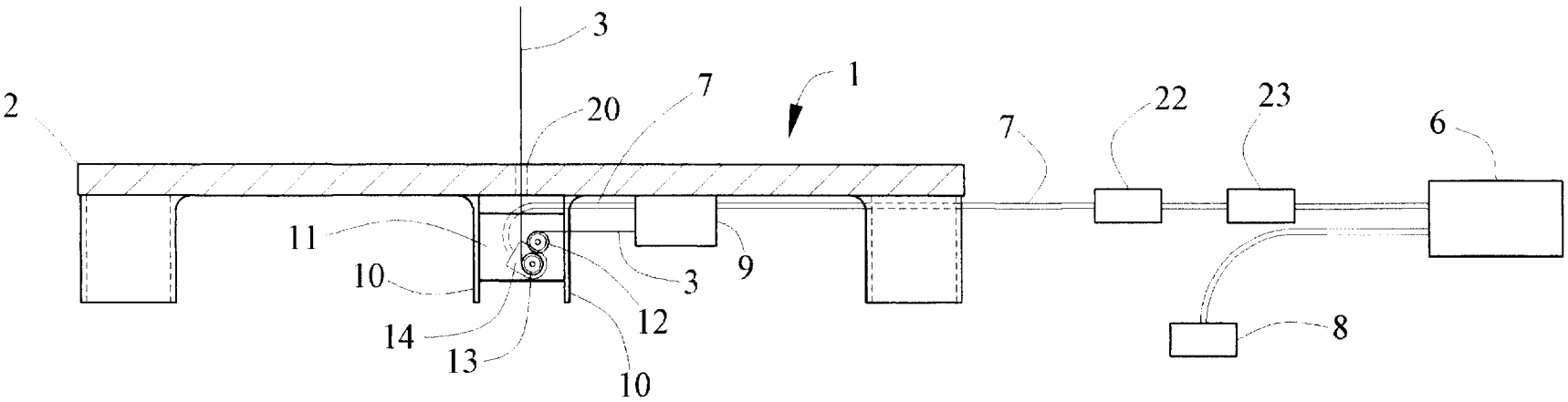
FIG. 3 is side cross-sectional views of various preferred embodiments of the present invention.
Figure 4:
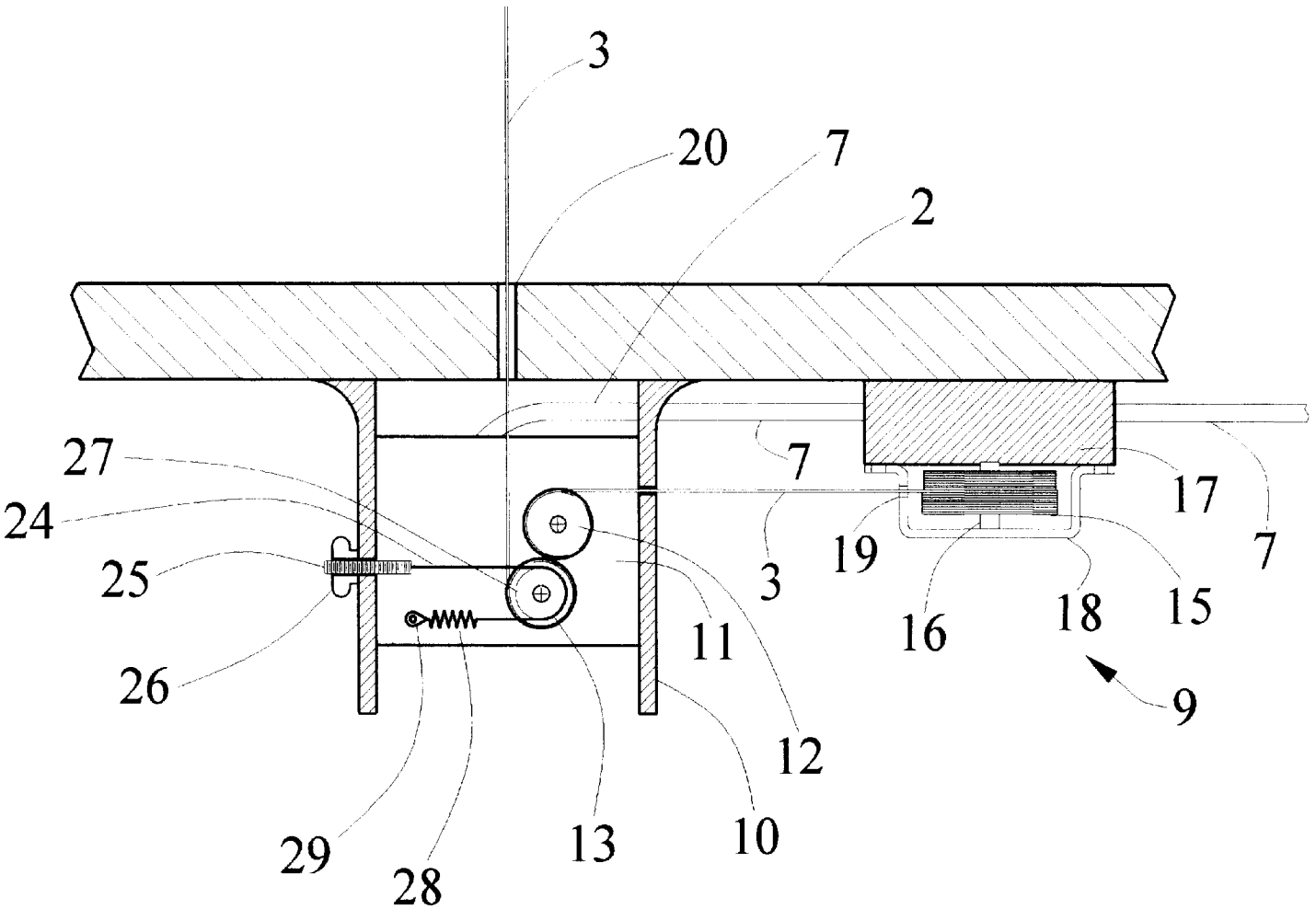
FIGS. 4 and 4*a* are opposite side cross-sectional views of various preferred embodiments of the present invention.
Figure 4A:
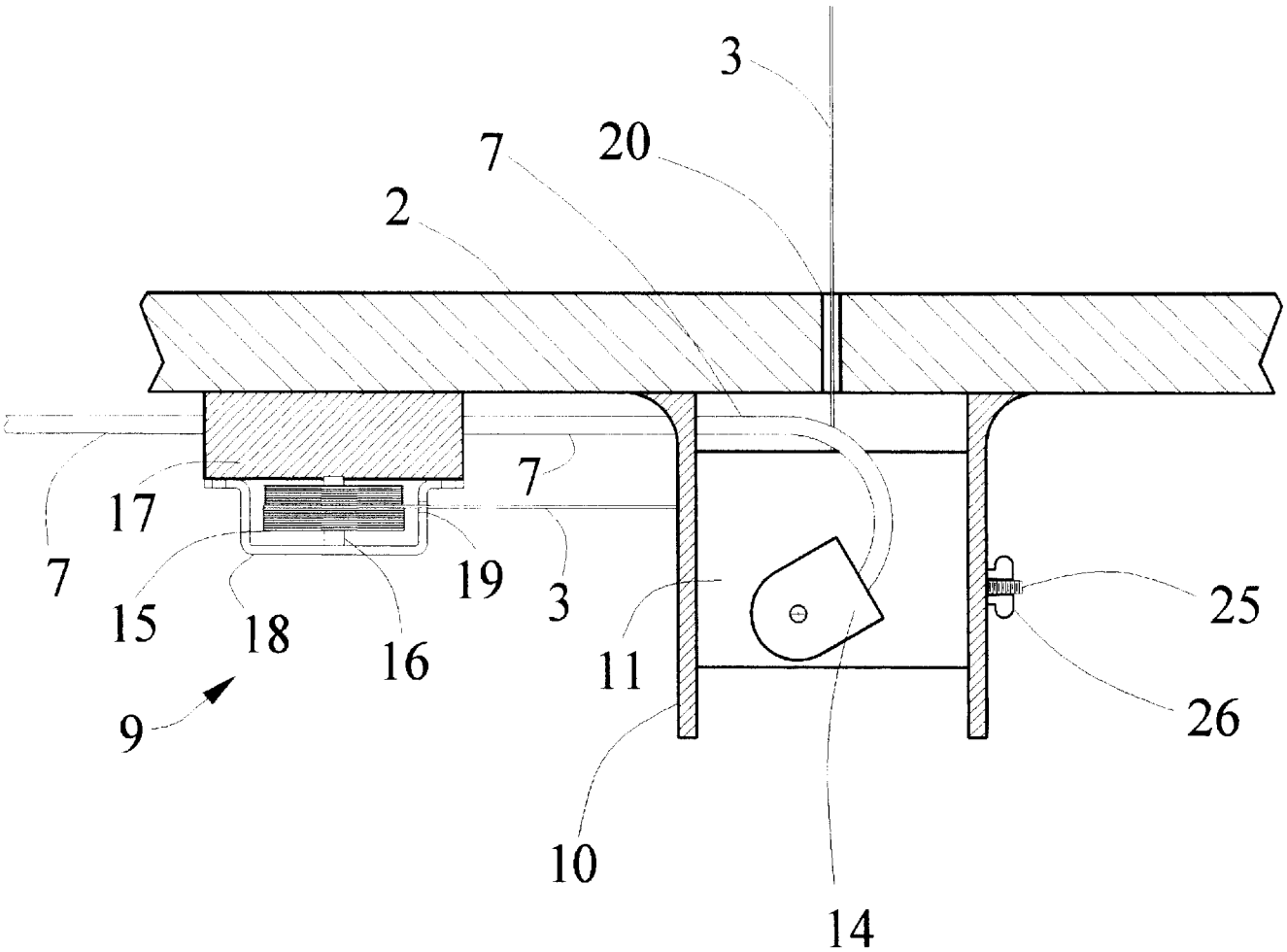

A more detailed description of the performance measurement device can be more readily appreciated by referring to the cross-sectional cutaway views in FIGS. 3, 4 and 4*a*. The platform, 2, comprises a slot, 20, through which the retractable tether, 3, transits. The retractable tether, 3, engages a coupled roller, 13, the rotation of which is correlated to the displacement of the retractable tether. For example, without limiting the scope of the invention to that shown in the Figures, if the tether is withdrawn from the platform the coupled roller, 13, will rotate clockwise, and if the tether is retracted into the platform the coupled roller will rotate counter-clockwise. The relationship between the degrees of rotation of the coupled roller and the magnitude of the displacement of the tether are therefore known. The coupled roller, 13, is coupled to an encoder, 14, which measures the degrees and rate of rotation, and the direction of rotation for the coupled roller. The degrees of rotation directly correlate to the magnitude of the displacement of the tether. The direction of rotation directly correlates to whether the tether is being withdrawn from the platform or retracted into the platform. The encoder is a preferred displacement measurement device. Other displacement measurement devices which determine the displacement of the tether are within the bounds of the present invention as would be apparant to a skilled artisan. The encoder, 14, is in electronic communication with a timer, 22. A signal conversion device, 23, correlates the time reported by the timer with the direction, rotation and displacement reported by the encoder and combines them in accordance with the instructions input by the user through the input/output device, 6. The power source, 8, may optionally be attached to the apparatus through the input/output device, 6, as shown.

To insure that the retractable tether, 3, and coupled roller, 13, are maintained in physical contact an optional, but preferred, idler roller, 12, is employed as well known in the art. It is preferred that the idler roller and coupled roller rotate in opposite directions but other configurations consistent with the intent of maintaining a taught relationship between the coupled roller and the retractable tether are contemplated.

A retractor, 9, is attached to the end of the retractable tether, 3. The retractable tether, 3, is attached to a pulley, 15, mounted on an axle, 16. A spring assembly, 17, is attached to the axle and biased to rotate the pulley in a manner which will wrap the tether around the pulley thereby acting to retract the tether. The retractor therefore insures that the retractable tether remains taught between the athlete and the retractor and it remains taught on the coupled roller and idler roller, if present. Retractors are commercially available from many suppliers. Preferred is a retractor with sufficient spring strength to insure that the retractable tether remains taught but not so strong as to inhibit the vertical displacement of the athlete. The rate of return of the retractor should be sufficient to retract the retractable tether at a rate sufficient to not allow slack in the retractable tether as the athlete, or apparatus, lowers. An eminently suitable retractor which is suitable for use in the present invention is a BD-Series retreiver reel 1/2#100 available from Schellinger Spring, Inc. of Rancho Cucamonga, Calif.

The idler roller, 12, coupled roller, 13, and encoder, 14, are preferably mounted on a mounting plate, 11. The mounting plate, 11, is preferably attached to the platform, 2, by at least one mounting bracket, 10, as would be apparent to one skilled in the art. The size and material of construction of the coupled roller and the idler roller are not particularly limiting. The size and construction of the coupler roller is preferably chosen to be large enough to insure that the retractable tether has sufficient contact to avoid slippage while still small enough, and light enough, to not impart enough rotational momentum to significantly alter the results. While not limited thereto 1–1.25 inch rollers have proven to be eminently suitable for the present invention.

Illustrated in FIG. 4 is an optional resistance device attached to the coupled roller, 13, to increase resistance for training purposes. The resistance device comprises a friction brake, 24, constructed of a suitable material such as braided cloth, strap steel, or the like. The friction brake, 24, wraps partially around a secondary wheel, 27, which may be integral to the coupled roller or mechanically coupled thereto. An adjustment screw, 25, and adjustment nut, 26, attached to one end of the friction brake are arranged to increase or decrease the pressure between the friction brake and the secondary wheel. The friction brake is preferable attached to a spring, 28, which is attached to the mounting plate by a lug, 29. Alternate attachment means are within the scope of the present invention including bolts, rivets, voids or other attachment means as known in the art.

Figure 5:
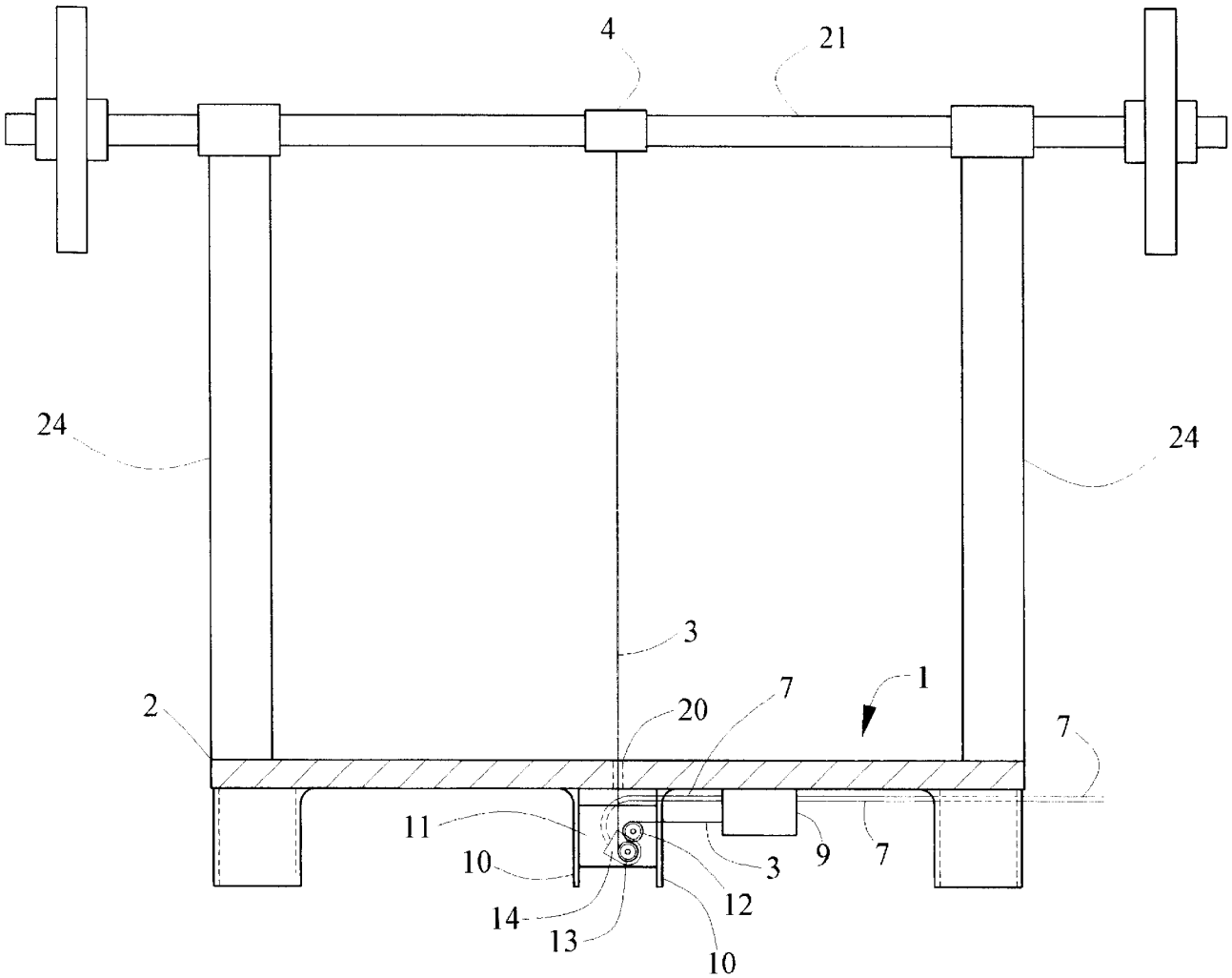
FIG. 5 is a cross-sectional view of another embodiment of the present invention.

Another embodiment of the present invention is provided in FIG. 5 wherein the ability to utilize the performance measurement apparatus in other manners is illustrated. In FIG. 5 the platform, 2, comprises a pair of removable supports, 24, which support an event apparatus, 21. An event apparatus is any device which the athlete wants to measure athletic power by determining the ability to move an event apparatus over a distance in a period of time. For purposes of illustration, the event apparatus in FIG. 4 is a standard bar bell with weights. The retractable tether, 3, is attached to the event apparatus, 21, by the tether attachment means, 4. The operation is substantially the same as that previously described except the weight is now that of the apparatus being moved instead of the weight of a jumping athlete.

It would be apparent to a skilled artisan that other event apparatus could easily be attached to the performance measurement device without departing from the scope of the present invention. Examples of event apparatus that would be contemplated include baseball bats, or similar apart, shot put, etc.

Figure 6:
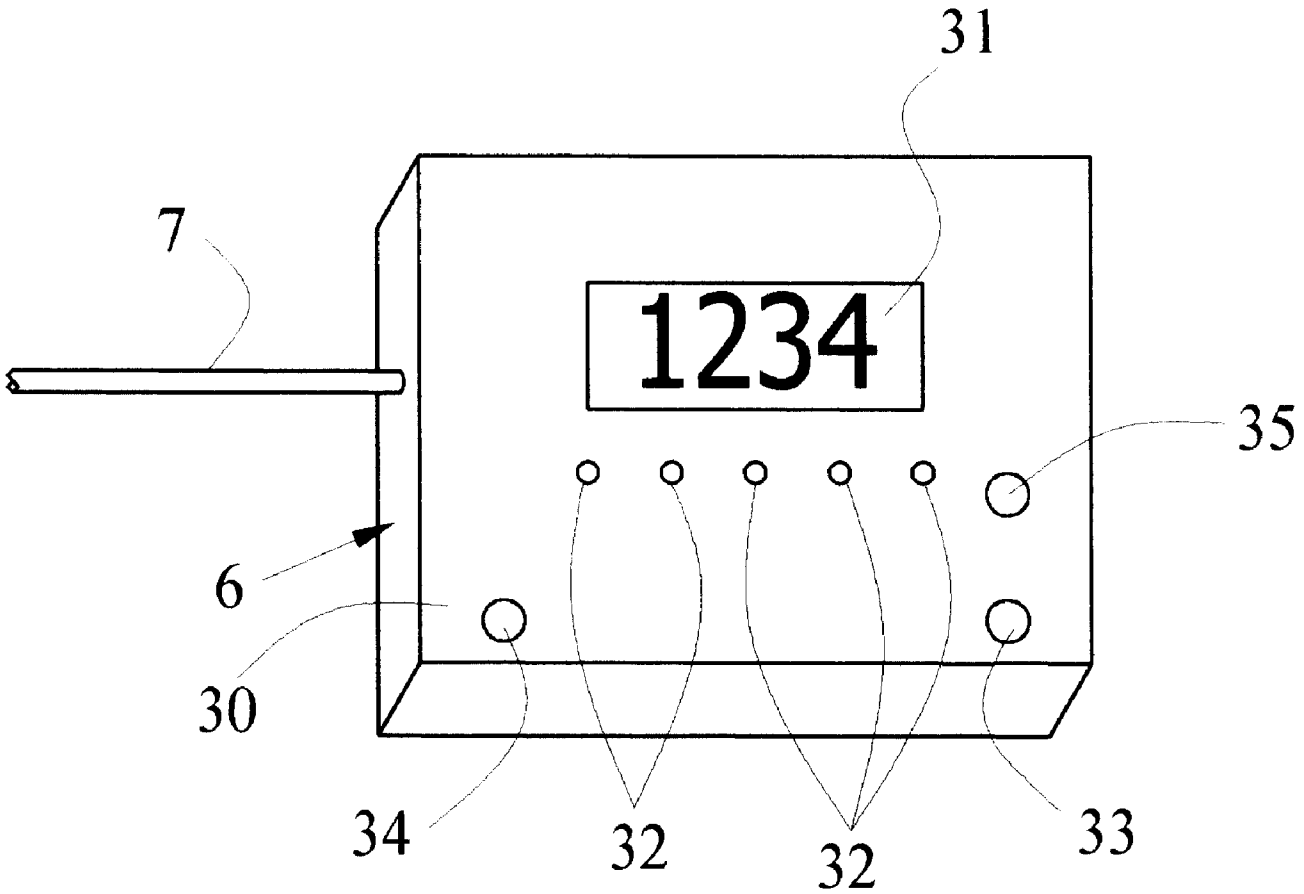
FIG. 6 is a top-side view of a preferred display device.

A preferred embodiment of the input/output device will be described in reference to FIG. 6. The input/output device, generally represented at 6, comprises a signal transfer means, 7, which relays information and power between the input/output device and the encoder and timer as described previously. The signal transfer means may include a physical connection such as a wire or a non-physical connection such as infrared light, radio frequency, ultrasonic frequencies or similar mechanisms common in the art of communication. The input/output device may be portable, or may be permanently mounted on the platform or a stand as would be apparent to one skilled in the art. The input/output device preferably comprises a face plate, 30, which is primarily for aesthetic appeal and as a location for graphics, logos and the like. A light emitting diode (LED) display, 31, is the preferred visual output device with other optional devices being contemplated. The display may provide information by text or graphics and may include such items as displacement, elapsed time, or derivatives based on these measurement either alone or in combination with other input variables.

Preferred is a multiplicity of preprogrammed buttons, 32, on the input/output device which are useful for inputting certain parameters. In a preferred embodiment, the buttons may include input for numbers wherein one button may be the units digit, one may be the tens digit, one may be the hundreds digit, etc. Other preferred preprogrammed buttons may toggle between various screens and it is most preferred that one button is a power on/off button. An audible alert means, 35, is optional, but preferred, to alert the athlete that the test parameters are set and to proceed with the test. The audible alert means may report for superior performance, poor performance or be based on other parameters as chosen by the user.

It is preferred that the input/output device comprise an output jack, 33, which may be used for sending information to a computer for analysis, a printer, an alternate display device, a storage device or any other data device common in the art. An input jack, 34, is also preferred for allowing input of parameters from a remote device such as a hand held unit, a computer, a keyboard or any other data transmission device common in the art. The output jack and input jack are not limiting but are preferably chosen based on convenience, and compatibility with commercially available plugs.

Figure 7:
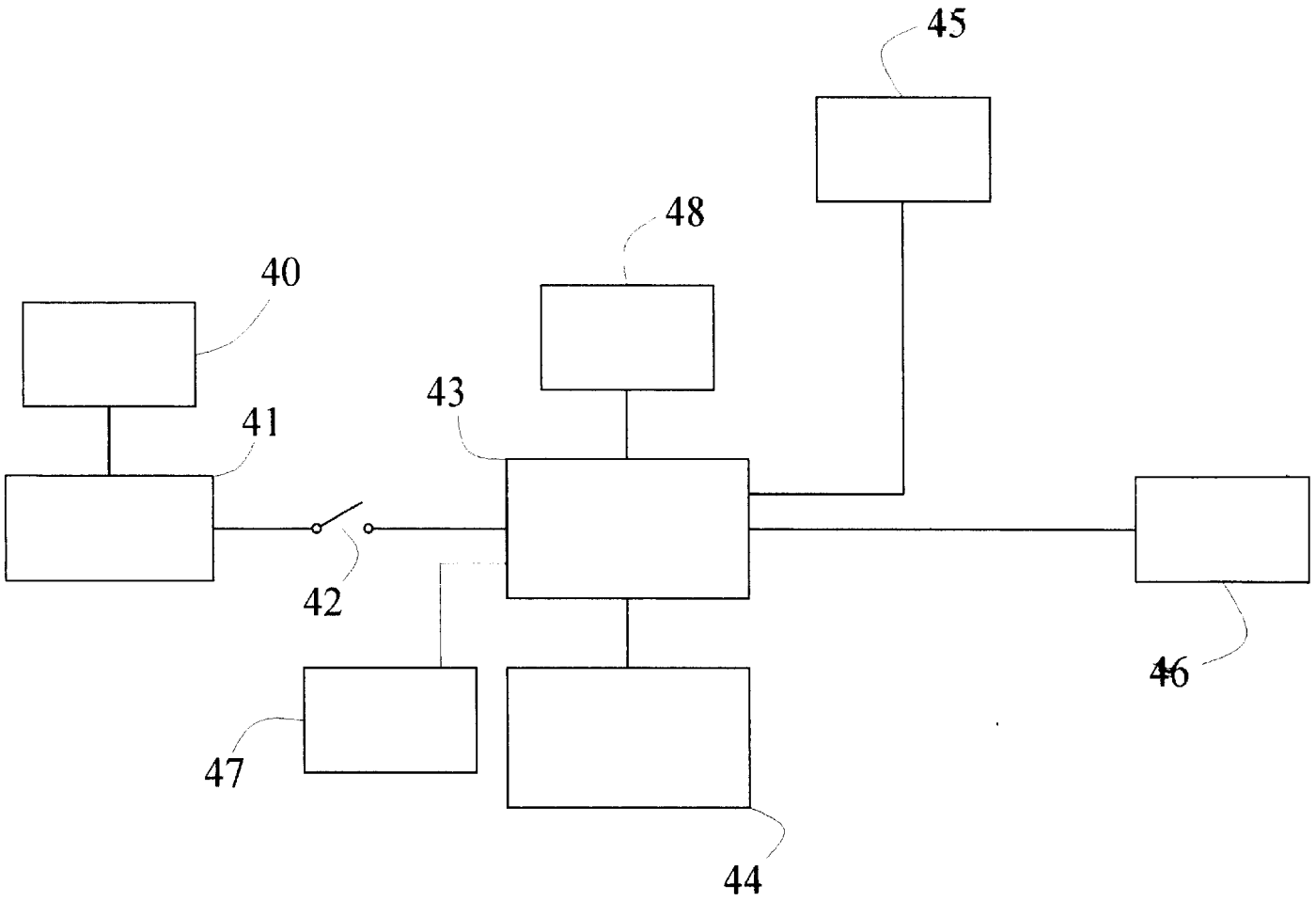
FIG. 7 is a block diagram of the preferred circuitry for the present invention.

A block diagram of a preferred embodiment is provided in FIG. 7. A power source, 40, and optional, but preferred regulator, 41, provide power to the unit through a switch, 42. The power source is not particularly limiting and many power sources are known in the art. Preferred power sources are alternating current and direct current. The power source and regulator, taken together, are chosen to provide the microcontroller and associated electrical components with the proper voltage. Preferred for the present invention is an alternating current power source with a regulator capable of converting the alternating current to +5 volts of direct current. A microcontroller, 43, receives and distributes the power. Microcontrollers are well known in the art. A particularly preferred commercially available microcontroller and board is a Basic Stamp II available from Parallax. An encoder, 44, monitors the direction of rotation, and the degrees of rotation of the coupled roller as described previously and relays the measurements to the microcontroller. The encoder can be coupled to the coupled roller by any means known in the art including mechanical and optical. A particularly preferred encoder is an optically coupled encoder available from Hewlett Packard as part number HEDS 5500. A timer, 47, provides a basis for determining elapsed time. The input module, 46, relays directions from the user to the microcontroller regarding the manner in which the data should be reported and the resulting report is relayed to a display device, 48, for displaying. An optional computer, 45, can be attached for data manipulation, data input, data storage and other functions as known in the art.

Figure 8:
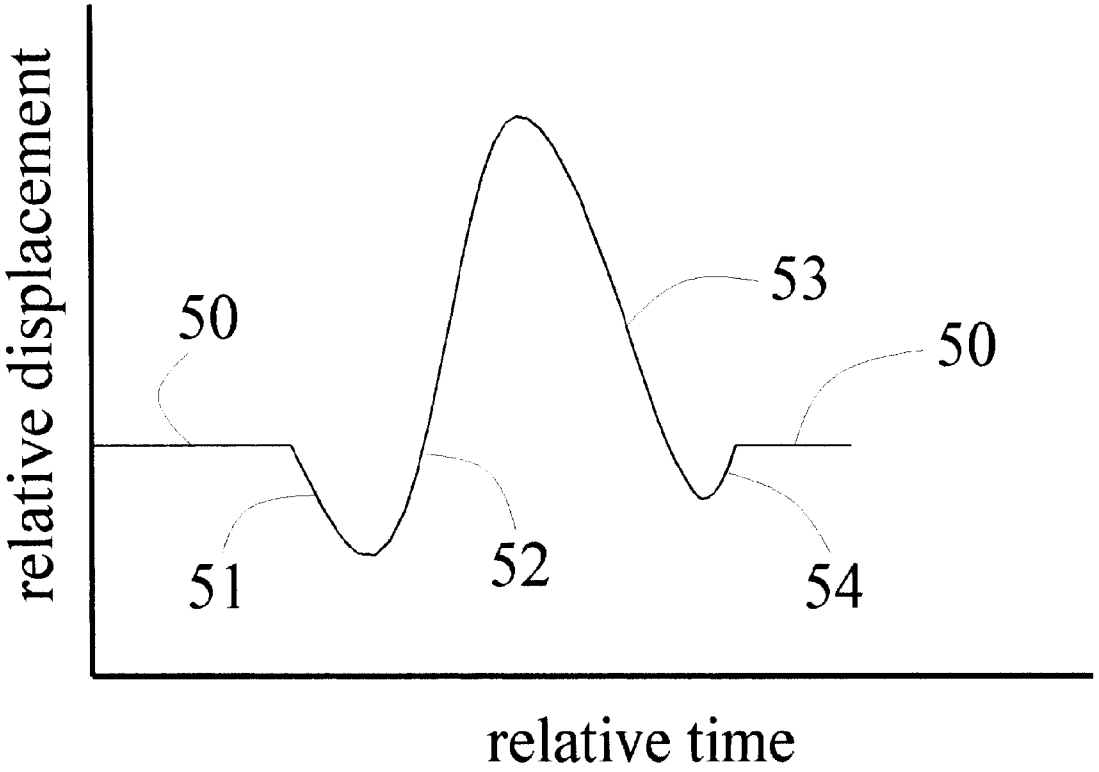
FIG. 8 is a graph illustrating relative displacement versus relative time for a single vertical jump.

FIG. 8 is a graph illustrating a typical relative displacement of an athletes waist versus time for a vertical jump. In FIG. 8 the athlete stands at a comfortable height, represented by 50. As the athlete prepares to jump the initial action is to squat to develop potential energy and therefore the waist lowers, as illustrated at 51. The athlete reaches the lowest point and jumps upward as represented at 52 the distance of which is taken as the magnitude of the displacement and represents the maximum vertical jump. At the zenith of the jump the athlete descends due to gravity as represented at 53. It is typical for an athlete to squat upon landing and must therefore stand upward, as represented at 54 before returning to the original comfortable height, 50. For purposes of the present invention, the elapsed time is taken as the time required for the maximum vertical jump.

The preferred attachment means attaches to the athlete, or apparatus, without substantially limiting freedom of motion. Particularly useful attachment means include belts, hook and latch members, and the like.

In practical applications the present invention is well suited for determining power output of an athlete based on a single event or based on a series of events. Particularly preferred routines which have proven to be of particular value to an athlete are provided herein as examples only without limiting the scope or spirit of the invention.

Vertical Jump For Determining Power Output a) The weight of the individual is entered into the input/output device in pounds.

b) The athlete does three warm-up jumps with the option to keep the highest jump for comparison purposes.

c) The athlete jumps and the power output (p) of the jump is determined by formula 1:

$$p=(W*H)/t \qquad \text{Formula 1}$$

wherein W is the weight of the athlete;

H is the maximum vertical jump; and t is the elapsed time for the maximum vertical jump.

Consecutive Vertical Jumps For Conditioning Evaluation a) The weight of the athlete is entered into the input/output device in pounds.

b) The athlete does three to five warm-up jumps.

c) The athlete does a series of test jumps wherein the displacement and elapsed time of each test jump is recorded.

d) The power output for each test jump is calculated by formula 1.

e) The power output and/or vertical jump as a function of time are evaluated to determine contributions due to fatigue.

Event Apparatus Power Measurement a) Enter the weight or resistance of event apparatus in pounds.

b) The athlete does three warm-up lifts, or pulls, with the option to keep the highest power output for comparison purposes.

c) The athlete lifts, or pulls, and the power output is determined by formula 1.

The preferred embodiment has been described as envisioned for use with a vertical jump. It would be apparent to a skilled artisan that the present invention could be incorporated into physical measurements wherein the apparatus measured horizontal displacement versus time with minor modifications as would be apparent to one skilled in the art. Examples include, for example, the power associated with an initial explosive move such as a dive as would be common in competitive swimming or the first move from blocks in competitive running. In these example the elapsed time, and displacement, from a first fixed point to a second fixed point would be used to determine the power output of the athlete. It would be apparent to one skilled in the art that various embodiments could be employed without departing from the scope of the invention.

Various embodiments of the present invention have been shown and described in a manner sufficient to allow a skilled artisan to appreciate the invention. It would be apparent to a skilled artisan that variations and modifications could be employed which would not depart from the scope and spirit of the present invention.

What is claimed is:

1. An apparatus for measuring at least one performance metric of an athlete comprising:

an elongated tether with a first end and a second end;

an attachment means attached to said first end of said elongated tether wherein said attachment means can be attached to said athlete such that a vertical jump by said athlete causes a displacement of said elongated tether proportional to a distance of said vertical jump;

a retractor attached to said second end of said elongated tether;

a displacement measurement device for determining a magnitude of said displacement of said elongated tether and generating a signal proportional to said magnitude;

a conversion device for receiving said signal from said encoder and converting said signal to said performance metric; and an output device for reporting said performance metric.

2. The apparatus of claim 1 further comprising a timer capable of measuring an elapsed time of said displacement.

3. The apparatus of claim 2 further comprising an input device for receiving an input parameter from a user.

4. The apparatus of claim 3 wherein said input parameter is a weight of said athlete.

5. The apparatus of claim 4 wherein said performance metric is power and said power is determined from said displacement, said elapsed time and said weight.

6. The apparatus of claim 1 further comprising a platform wherein said output device is mounted in said platform.

7. An apparatus for measuring a performance metric of an athlete comprising:

a base comprising a slot;

a tether traversing said slot;

an attachment means attached to said tether and capable of being attached to said athlete such that when said athlete moves away from said base said tether is withdrawn from said base through said slot creating a displacement;

an encoder capable of measuring said displacement and generating a signal wherein said signal corresponds to a magnitude of displacement;

a retractor attached to said tether wherein said retractor biases said tether into said base; and an output device for receiving said signal from said encoder and converting said signal to said performance metric.

8. The apparatus of claim 7 further comprising a coupled roller rotationally attached to said base wherein said tether and said coupled roller are engaged such that withdrawing said tether creates a rotation of said coupled roller wherein said rotation is proportional to a magnitude of said displacement.

9. The apparatus of claim 8 wherein said encoder is coupled to said coupled roller and capable of measuring said rotation of said coupled roller and determining said magnitude of said displacement from said rotation.

10. The apparatus of claim 7 further comprising a timer capable of measuring an elapsed time of said displacement.

11. The apparatus of claim 7 further comprising an input device for inputting at least one parameter.

12. The apparatus of claim 11 wherein said parameter is a weight of said athlete.

13. The apparatus of claim 12 further comprising a timer capable of measuring an elapsed time of said displacement and said performance metric is power output.

14. The apparatus of claim 7 wherein said performance metric is a maximum vertical jump.

15. The apparatus of claim 10 wherein said performance metric is said elapsed time of a maximum vertical jump.

16. An apparatus for measuring a power output comprising:

an elongated tether with a first end and a second end;

an attachment means attached to said first end of said tether;

a retractor attached to said second end of said tether wherein said retractor allows said tether to be withdrawn from said retractor while remaining taught between said first end and said second end;

a displacement measurement device for determining a displacement of said tether and generating a signal proportional to said displacement;

a timer integrated with said encoder and capable of measuring an elapsed time for said displacement;

an input device for inputting a weight required to withdraw said tether;

a conversion device for receiving said signal, said elapsed time and said weight and calculating said power output; and a display device for displaying said power output.

17. The apparatus of claim 16 wherein said attachment means attaches to an athlete.

18. The apparatus of claim 16 wherein said attachment means attaches to an event apparatus.

19. The apparatus of claim 16 wherein said weight is a body weight of an athlete.

* * * * *